United States Patent [19]

Wennerstrum

[11] Patent Number: 4,856,203

[45] Date of Patent: Aug. 15, 1989

[54] MICROWAVE VACUUM DRYER

[75] Inventor: Scott Wennerstrum, Chicago, Ill.

[73] Assignee: The Fitzpatrick Company, Elmhurst, Ill.

[21] Appl. No.: 144,406

[22] Filed: Jan. 15, 1988

[51] Int. Cl.[4] ..... F26B 19/00

[52] U.S. Cl. ..... 34/68; 34/17; 34/92

[58] Field of Search ..... 34/1, 4, 68, 69, 241, 34/15, 92

[56] References Cited

U.S. PATENT DOCUMENTS 4,015,341 4/1977 McKinney et al. ..... 34/4

4,250,628 2/1981 Smith et al. ..... 34/69

*Primary Examiner*—Henry A. Bennet

*Attorney, Agent, or Firm*—Allegretti & Witcoff, Ltd.

[57] ABSTRACT

A mechanism is disclosed for microwave vacuum drying of pharmaceutical powders and the like. The mechanism includes a drying chamber, a source of microwave radiation, a means for mixing product within the chamber, and a means for introducing a vacuum into the chamber during the drying process. The chamber is vertically oriented, with the microwave radiation introduced at the top of the chamber and mixing occurring at the chamber's bottom. The chamber has a removable lid at its top, and a support structure adapted for loading and unloading dried product from the chamber. The mixing mechanism is a motor driven shaft with one or more mixing blades. The shaft and blades may be microwave transparent. In the preferred embodiment, the chamber is sufficiently deep such that a layer of product to be dried can cover the shaft and blades and microwave radiation can be prevented from penetrating through the product to the shaft and blades. In an alternative embodiment, liquid pharmaceuticals on other liquids may be sprayed on the product during the drying operation.

22 Claims, 4 Drawing Sheets

74
72
70
69
64
62
48
52
76
78
66
46
90
88
58
88
60
86
88
82
96
80
56
56
50

MICROWAVE VACUUM DRYER

BACKGROUND OF THE INVENTION

This invention relates to mechanisms for drying using a microwave and vacuum process. More particularly, it relates to an improved drying chamber for use in drying pharmaceutical powders, granules, tablets and the like using a combination of microwave energy, product mixing and application of a vacuum.

The combined use of microwaves and a vacuum to dry various materials has become commonplace and has been applied in a variety of industries. Typical of the application of microwave drying to industrial uses is the disclosures of McKinney, U.S. Pat. No. 4,015,341 issued Apr. 5, 1977, for "Seed Drying Process and Apparatus", and Durant, U.S. Pat. No. 4,229,886 issued Oct. 28, 1980, for "Microwave Heated Vacuum Dryer for Powders". Microwave vacuum drying processes are also useful in the pharmaceutical industry, as described in the applicant's co-pending application Ser. No. 037610, filed Apr. 13, 1987, the disclosure of which is hereby incorporated by reference.

The microwave vacuum drying art, is however, still in its infancy. Devices capable of performing the drying function are often bulky, cumbersome and constructed with an excess of parts. In some instances, the shortcomings of the devices results in relatively inefficient equipment that is difficult to manufacture and use.

These drawbacks are particularly present in the designs for microwave vacuum drying chambers. Drying chambers must perform multiple functions. The chamber must provide a fully enclosed containment area for the microwaves that does not allow leakage of stray microwave energy. The chamber must be air tight, often for lengthy drying periods. In the pharmaceutical industry, chambers must usually include some means for mixing or rearranging the position of the product to be dried to prevent uneven product drying. The chamber must not allow condensation of water (or other product solvent) on its interior. In the case of powdered pharmaceuticals, such condensationcan cause the product to be "lumpy" or unevenly dried.

The chamber must also have numerous entry ports for sensors and other observation and monitoring devices, such as temperature, pressure or microwave field strength sensors, or ports for viewing the product during drying. The chamber should be easily cleaned, so that a variety of different pharmaceutical products can be dried within the chamber without any residue from a previous product left in the chamber to contaminate the subsequent batch. It is also desirable to mix, granulate and dry in a single chamber. The chamber should make loading and unloading of the product a task that does not require excessive time, labor or complicated procedures. Because of these requirements, many drying chambers used in the past, while effective in accomplishing their intended purposes, have not fully met all of the necessary criteria, due to the use of complicated configurations that increase the difficulty of manufacture, require more space than necessary, and are complicated to use.

Mixing or agitation of the product within the drying chamber has posed a number of difficult problems. The portion of the mixing mechanism operating within the drying chamber must normally be transparent to microwave radiation to prevent damage to the product and equipment from excessive energy concentration. The mixing mechanism must nevertheless be sufficiently sturdy and durable to move substantial volumes of product, if the apparatus is constructed to mix a commercially viable quantity of product. The mixing mechanism must also be capable of providing thorough mixing so that unevenly dried pockets of product are not produced. High shear mixing can damage the product being dried. Metal mixing elements provide the necessary strength for rapid mixing, but can damage the product and are not transparent to microwaves. Mixing elements made of synthetic materials, such as polypropylene or similar plastics, are gentler than metals and sufficiently transparent to microwaves. Such plastics, however, are easily scratched or damaged and are less capable of high volume mixing.

All of these criteria must be accomplished within a drying chamber having the limitations described above. Provision of a solution to these problems is therefore the intent of this invention.

OBJECTS OF THE INVENTION

Accordingly, it is an object of this invention to provide an improved drying chamber for a microwave vacuum drying apparatus.

A further object of this invention is to provide a microwave vacuum drying apparatus that has a drying chamber that is simple to use.

Another object of this invention is to provide a drying chamber, for a microwave vacuum drying apparatus, that is simple and economical to manufacture.

An additional object of this invention is to provide a drying chamber for a microwave vacuum drying apparatus that allows drying of a high volume of pharmaceutical product in a short time.

Yet another object of this invention is to provide a microwave vacuum drying apparatus with a drying chamber that is easy to load and unload with product.

Still another object of this invention is to provide a microwave drying apparatus with a drying chamber that is easy to clean.

Still a further object of this invention is to provide a microwave drying apparatus with a drying chamber that has internal and effective produce mixing during the drying operation.

Yet an additional object of this invention is to provide a drying chamber for a microwave vacuum drying apparatus that results in fast product drying with minimum product or apparatus damage.

SUMMARY OF THE INVENTION

These, and other objects of the invention are accomplished by providing an improved chamber for microwave vacuum drying. The chamber is oriented vertically, with the microwave source directing radiation from the chamber's top. The chamber includes an internal mixing mechanism positioned at the bottom of the chamber and capable of moving product to be dried throughout the chamber. The chamber may be of sufficient depth so that if it is filled, the layer of product above the mixing mechanism shields that mechanism from microwave radiation, and thereby allows the mixing mechanism to be constructed of a material that is not microwave transparent. A plastic (or other microwave transparent) material is used if the product depth is not sufficient to cover the mixing mechanism. In the preferred embodiment, the chamber is pivotally mounted on a movable support that separates from the lid. The chamber can pivot to dump the product, and the chamber is easily washed by directing cleaning fluid into the chamber with the top removed and the chamber pivoted.

BRIEF DESCRIPTION OF THE DRAWINGS

In the following detailed description, reference is made to the following figures, wherein like elements are referred to by like numerals.

DETAILED DESCRIPTION OF THE PREFERRED EMBODIMENT

Figure 1:
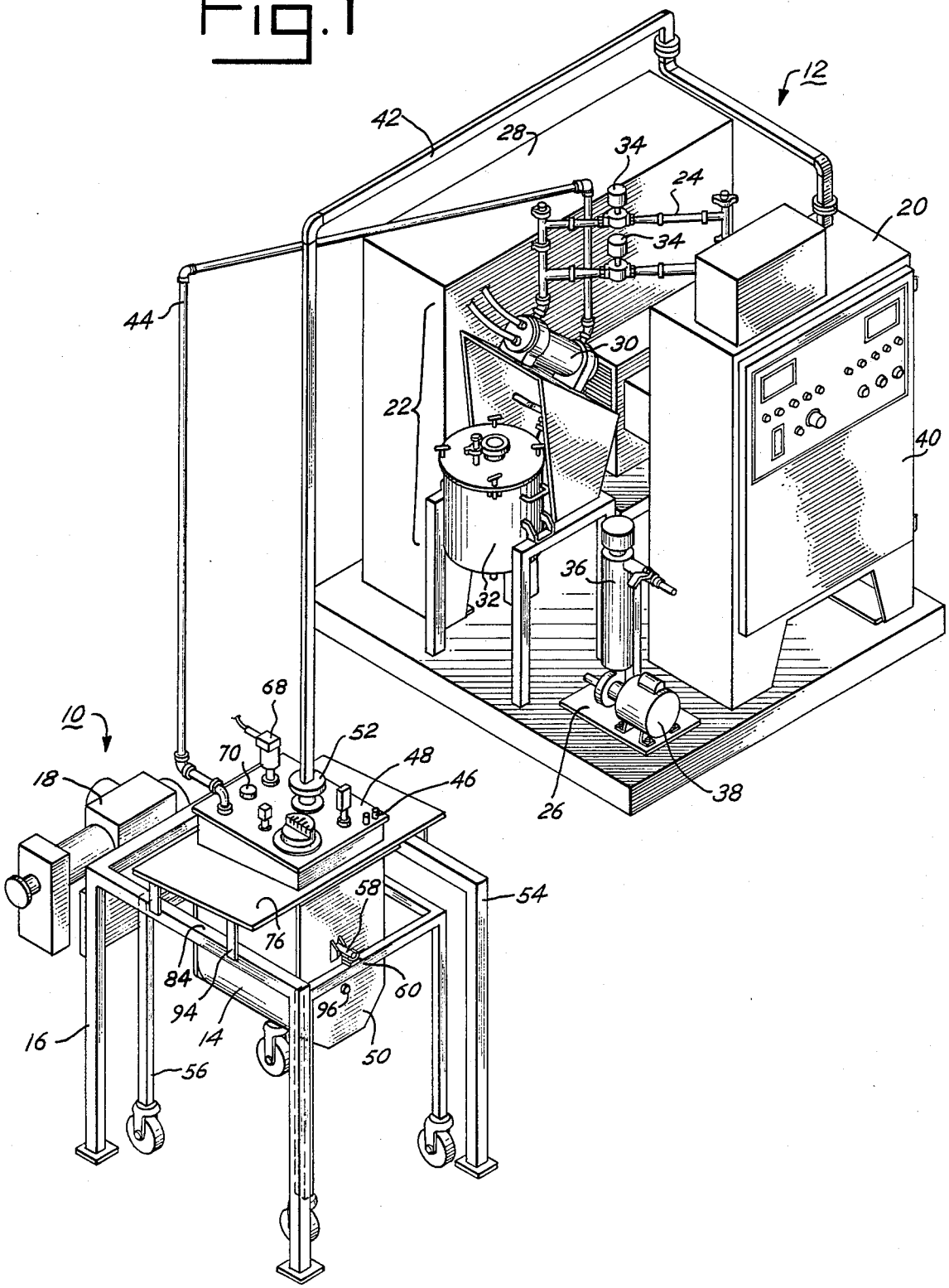
FIG. 1 is a perspective view of a preferred embodiment of the invention showing both the exterior of the drying chamber and microwave generator, vacuum and condenser systems used with the invention.

Referring to now to the illustrations, and in particular to FIG. 1 (which illustrates the preferred embodiment of the invention), the invention includes a drying chamber assembly 10 and a support equipment assembly 12. The drying chamber assembly includes of a chamber 14, supports 16 and a drive motor system 18. The drive motor system drives a rotatable mixing mechanism that is internal to the chamber 14.

The support equipment assembly generally comprises four systems, a microwave generator system 20, a condensate system 22, a vacuum system 24, and water jacket heating system 26. The microwave generator, condensate, vacuum, and water jacket heating systems are all operated in accordance with the disclosure of my co-pending application Serial No. 037610. Those systems are controlled by an electrical system primarily contained in electrical components cabinet 28 and monitored by a control and readout unit (not shown).

Although the details are contained in my co-pending patent application incorporated by reference in this specification, the condensate system generally comprises a condenser 30, a chiller (not shown) and a condensate reservoir 32. The vacuum system generally comprises a vacuum pump (not shown) that draws air out of the chamber 14 through the condenser 30, and remote operated valves 34, which are used to control the vacuum level. The water jacket heating system generally comprises a water pump 38 and a water heater 36. The microwave generator system consists of a microwave generator 40 connected by wave guides 42 to the chamber 14. The vacuum system 24 is connected to the chamber 14 through a vacuum line 44, and the water jacket heating system is connected to the chamber 14 through water lines (not shown) connecting to the chamber at the water jacket inlets and outlets 46. The preferred embodiment also includes electrical wiring (not shown) connecting the control system to the various sensors and mechanisms of the drying chamber.

The drying chamber 14 is oriented vertically, and is comprised of two major parts, a lid 48 positioned above a drum 50 when the chamber 14 is in the drying position. The microwave inlet 52 is then on the lid at the top of the chamber 14, and microwaves are directed downward onto the product to be dried.

The drying chamber supports 16 includes a stand 54 supporting the lid 48 and the drive motor system 18, and a cart 56 supporting the drum 50. The drum 50 can be removed from the lid 48 by rolling the cart 56 out of the stand 54. The drum 50 may then be dumped, because the drum is pivotly mounted on the cart 56 by pivots 58 resting in pivot mounts 60.

Figure 2:
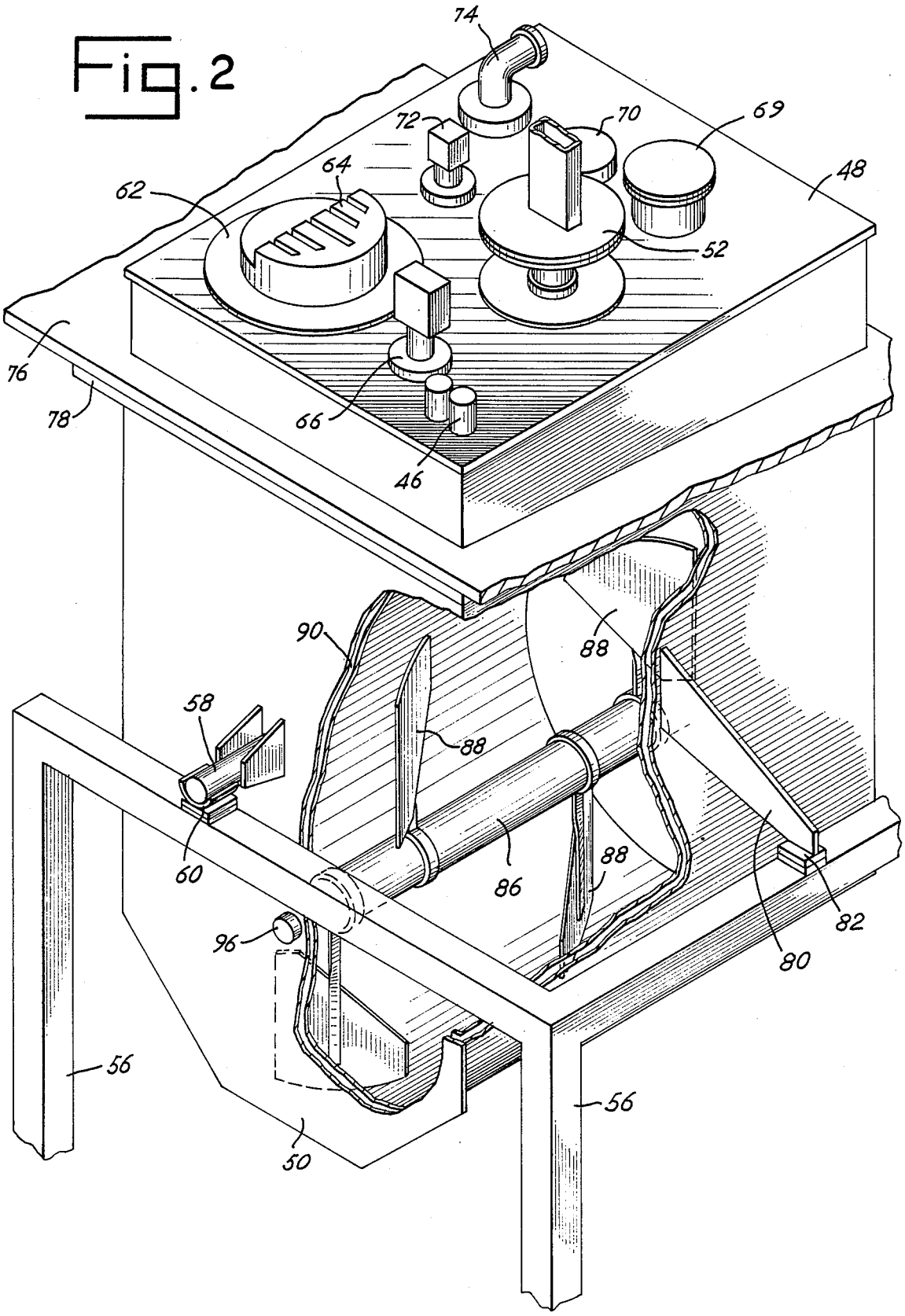
FIG. 2 is a cutaway perspective view of the preferred embodiment of the drying chamber, showing the mixing mechanism in the chamber's interior.
Figure 3:
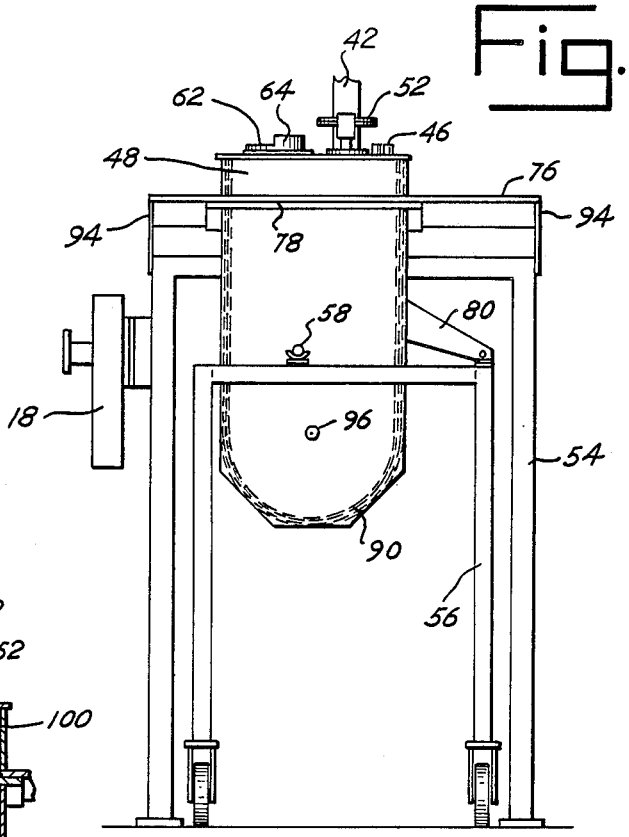
FIG. 3 is a side view of the exterior of the chamber, illustrating the chamber's loading and unloading arrangement.

Referring now to FIGS. 2 and 3, additional details of the chamber 14 are disclosed. The lid 48 includes a viewing window 62 that allows observation of the drying process while microwaves are radiated within the chamber 14. In the preferred embodiment, the viewing window includes a light 64, and a screen in front of the window's sight glass to prevent microwave leakage. The lid is also adapted to contain a temperature gauge port 66, a field strength sensor port 69, and auxiliary port 70 (which may be used, for example, as an input for fluid spray), a back-to-atmosphere valve 72 and a vacuum line inlet port 74.

The arrangement of sensors in the ports can very, so that other gauges can be placed in the ports, and for that reason, the closed port 70 is shown in FIG. 2 as corresponding to the position of the field strength port 69 of FIG. 1. In the preferred embodiment, the lid 48 includes a lip 76 that rests in contact with a flange 78 on the drum. The lip and flange provide a contact surface for a conductive gasket or "O" ring that provides both a gas and electrical seal between the lid and drum and prevents leakage of microwave radiation. Also in the preferred embodiment, the stand 54 has arms 84 on both sides of the chamber 14. The lip 76 then is connected to both arms of the stand and is rigidly supported on the stand by those arms.

To be pivotally mounted, the pivot mounts 60 on the cart 56 are semicircular and open at the top, allowing the pivots 58 to rotate within the pivot mounts, and allowing the entire assembly to be lifted from the cart. The drum is stabilized on the cart by an arm 80 having a foot 82 that rests on the top of the cart 56 when the drum is fully installed underneath the lid.

The mixing mechanism of the invention includes a shaft 86 arranged horizontally within the drum. The shaft then has a plurality of blades 88 mounted about the shaft. The internal surface of the lower portion of the drum 50 is circular, so that the blades 88, during rotation of the shaft 86, move along the surface of the interior of the drum and provide thorough mixing of all product within the drum. In the preferred embodiment, the blades are generally triangular and mounted with one point of the triangle at the shaft, although other agitator blade types may be employed. Using this configuration, thorough mixing of the product can occur at the low shaft rotation speeds necessary to prevent damage to the product being dried. Further, the preferred embodiment of the shaft and blades uses a material that is transparent to microwaves, such as polypropylene. However, in an alternative embodiment, the shaft and even the blades can be made of a metal material, if the shaft and blades, during a drying operation, are covered by a sufficient quantity of product such that microwaves do not penetrate in high strength through the product to the metallic portions of the mixing mechanism.

As illustrated in FIGS. 2, 3, 4, and 5, the preferred embodiment of the chamber 14 includes hollow walls comprising a water jacket 90. The water jacket allows continuous circulation of heated water throughout the walls and thereby prevents condensation of evaporated solvent on the interior surfaces of the chamber.

After the product has been dried in a chamber using the preferred embodiment, the cart 56 is rolled away from the stand 54, and then the drum 50 is pivoted about the pivot mounts 60 and the dried product 98 is dumped into a separate container, the drum 50 can then be cleaned in the conventional matter by spraying it with water or solvent. In alternative embodiments, the drum can be configured with a product discharge valve at its bottom, or a conveyor can be constructed to move product outside of the drum.

Figure 4:
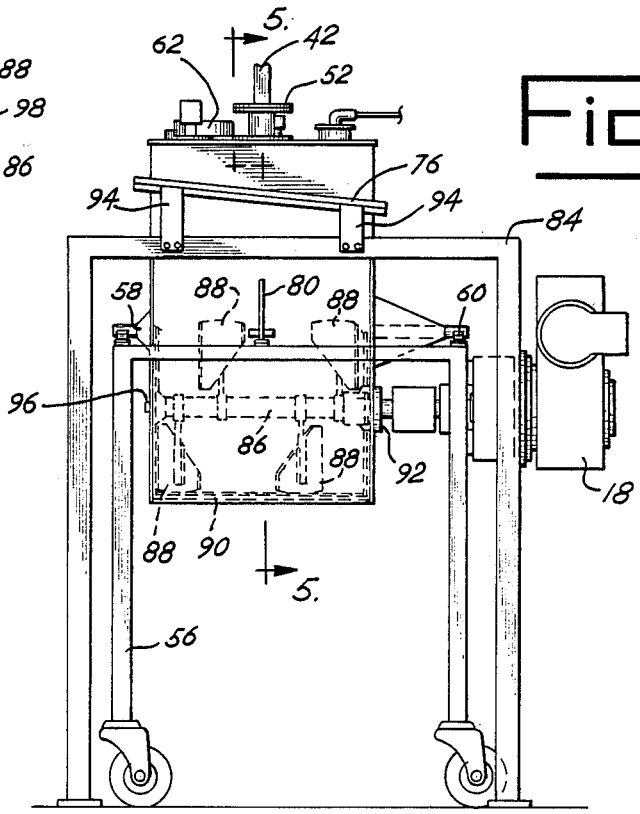
FIG. 4 is a front view of the exterior of the chamber, showing the mixing mechanism, and further showing the chamber's loading and unloading arrangement.

As best illustrated in FIG. 4, the lip of the lid and the flange of the drum are both configured at a slight incline to the horizontal, with both parallel to each other. By use of the incline, the chamber can be configured to have a slight pressure seal between the lid and the drum when the cart is rolled into the stand and under the lid. The lip is connected to the arms 84 by a group of support bars 94 which, in the preferred embodiment, are attached to the lip and bolted to the arms. Also as best illustrated by FIG. 4, the drive motor system 18 includes a coupling 92 that connects to the shaft 86. The coupling is air tight and designed to minimize microwave leakage between the shaft and the drive motor system. The coupling is also designed to be detachable. The chamber 14 also includes a air seal and cleaning port 96 in the lower portion of the chamber at the point of contact of the shaft 86 with the walls of the drum.

Figure 5:
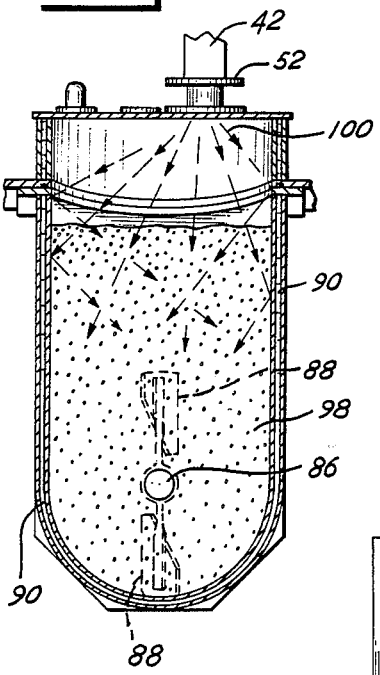
FIG. 5 is a side cross-sectional view of the interior of the drying chamber of FIG. 4, shown during operation.

Referring now to FIG. 5, the internal operation of the microwaves within the chamber is illustrated. In the preferred embodiment of the invention, the shaft 86 and the blades 88 can either be made out of a microwave transparent material or a metal that is sufficiently grounded to the chamber and covered by enough material such that most of the energy is absorbed by the layer of product above the shaft and blades. Of course, essential to operation of a system having only limited penetration of microwaves into the product 98 is thorough mixing of the product during the drying operation, such that the product near the bottom of the drum, at some time during drying, migrates to the top of the drum and is thereby dried by the microwave energy. The illustration of FIG. 5 is only one way in which the invention may be operated. Different drying applications may call for different quantities of product in the chamber, so that the product need not be filled in the chamber to the height of shown.

In addition to the preferred embodiment, alternative arrangements can be constructed using the invention. Some of those alternative arrangement comprise modifications or additions to the preferred embodiment. For example, the auxiliary port 70 can be used to contain a variety of different sensors, such as humidity sensors or sensors that detect the presence of a particular chemical vapor. A "chopper" can also be added to the chamber, either by mounting a chopper on the lid 48, or by mounting the chopper through the auxiliary port 70. A chopper, also known as a granulator, provides for additional separation of blocks of product during the granulation and drying operation. Moreover, a chopper can be provided that is mounted through any side of the drum. The chopper is usually metal, and is then removed before drying begins. However, if the chopper is made of a microwave transparent material, or is placed below a sufficent layer of product, then the chopper can be used during drying. The auxiliary port (or other ports) can further be used to introduce a fluid spray into the chamber (such as a pharmaceutical binder or solvent), so that a granulating, drying, and coating operation can be conducted in a single chamber.

Figure 6:
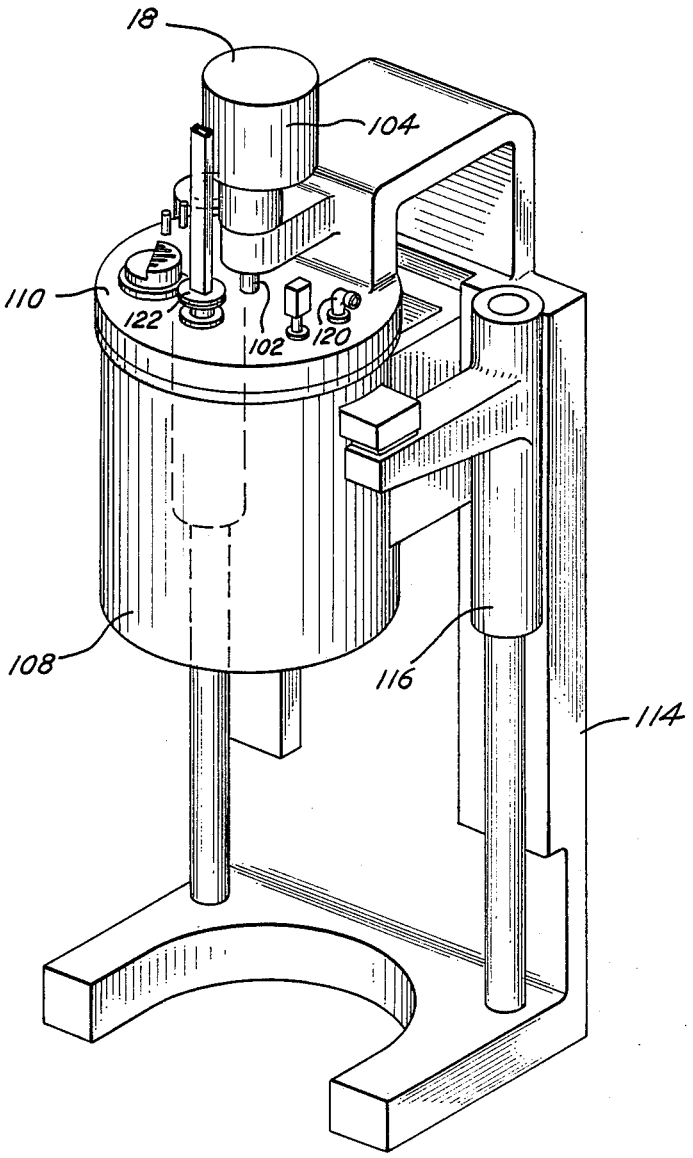
FIG. 6 is a perspective view of an alternative embodiment of the invention with a vertical axis mixing mechanism.

Referring now to FIG. 6, an alternative embodiments of the invention are disclosed. As best disclosed in FIG. 6, the drive motor system can include a vertical shaft 102 attached to a vertically oriented drive motor 104. The vertical shaft in turn can be attached to rotating blades (not shown) that mix a product during the drying operation. As in the preferred embodiment, the product container includes a drum 108 and a lid 110. The lid and drum are connected by a conducting gasket. The drum 108 is supported by a stand 114, and is moved vertically on the stand by one or more hydraulic cylinders 116. The lid 110 is affixed to the stand, so that operation of the hydraulic cylinders 116 lowers the drum away from the lid to provide access to the drum's intention. Also as in the preferred embodiment, the drum 108 has a water jacket and a plurality of access ports 120 for sensors and the like, along with a microwave inlet 122.

The alternative embodiment can be constructed with a drum having a square cross section as illustrated FIG. 6, or it can be constructed with a drum having a kettle shape. The drum is preferably removable from the hydraulic cylinders, and may rest on a rolling cart or dolly when fully lowered. Moreover, the vertically oriented drive motor can be mounted under the base of the drum 108, rather than on the lid 110. In the embodiment of FIG. 6, either the field strength must be kept very low or the shaft needs to be cooled (by water flowing internally in the shaft) to prevent heat build up. However, if a sufficient layer of product is placed within the drum 108 to reduce microwave radiation penetration, then the lower portion of the shaft 102 and the rotating blades can all be made of a metallic material. If the drive motor is placed below the drum, the entire set of blades and shaft can be constructed of metallic material so long as a suitable layer of product overlies the shaft and blades and prevents penetration of microwaves. Of course, any time a metallic material is used for either the shaft or blades, the mixing mechanism must provide sufficient movement of product so as to cause exchange of the product above the blades with the product in the vicininty of the blades at the bottom of the drum.

The terms used in the claims and specification should not be construed in their most limited sense. For example, the term "chamber" should be construed synonymously with the common industry term "product container" and should include any arrangement of containers suitable for holding product during a microwave vacuum drying operation. Likewise, terms such as "upper", "lower", "vertical", and "horizontal" should not be construed as limitations unless expressly included within the claims. Moreover, when terms such as "vertical" and "horizontal" are used in the claims, they should not be construed in their strictest sense, i.e., arrangements are possible that have substantial deviations from actual "verticality" an still be within the intent of the claims.

While the preferred embodiments of the present invention have been set forth in the above detailed description, the preferred embodiments are only examples of the invention. Other modifications may be used without departing from the scope of the present invention, and the invention is limited only by the following claims and their equivalents.

What is claimed is:

1. A microwave vacuum drying apparatus for drying a product, comprising, in combination:

a source of microwave radiation;

a vertically oriented product drying chamber connected to the source of microwave radiation, with the inlet for the microwaves positioned at the top of the drying chamber, the drying chamber further comprising a lid at the chamber's top and a separable drum attached beneath the lid;

a structure for maintaining a vacuum into the chamber;

a mechanism for mixing the product in the chamber;

a control system for the mixing mechanism, microwave radiation source and vacuum structure; and a support for the chamber, the support comprising a stand supporting the lid and a rolling cart supporting the drum and the drum is pivotally mounted on the rolling cart, whereby the drum may be loaded or unloaded by rolling the cart away from the stand and pivoting the drum on the cart to dump the product with the support being adapted to move the chamber from a drying position to a discharge position and adapted further to allow the chamber to dump product when in the discharge position.

2. A microwave vacuum drying apparatus as claimed in claim 1 wherein the drying chamber is surrounded by a water jacket that may be heated to aid drying and prevent condensation of condensed solvent from the dried product on the interior surfaces of the chamber.

3. A microwave vacuum drying apparatus as claimed in claim 2, wherein the inlet to the chamber for the microwaves and vacuum structure are contained on the lid.

4. A microwave vacuum drying apparatus as claimed in claim 3, wherein the chamber further comprises sensors that sense internal microwave field strength, internal temperature and internal pressure, with all sensors mounted on the lid.

5. A microwave vacuum drying apparatus as claimed in claim 1 wherein the mixing mechanism is motor driven, and the drive motor is mounted on the stand.

6. A microwave vacuum drying apparatus as claimed in claim 1 wherein the mixing mechanism is motor driven, with the drive motor mounted on the stand and detachably coupled to the drum.

7. A microwave vacuum drying apparatus as claimed in claim 1, wherein the mixing mechanism comprises a motor driven rotatable shaft internal to the chamber, with the shaft having one or more mixing blades that mix the product as the shaft rotates.

8. A microwave vacuum drying apparatus as claimed in claim 7, wherein the shaft is horizontal.

9. A microwave vacuum drying apparatus as claimed in claim 8, wherein the shaft is vertical.

10. A microwave vacuum drying apparatus as claimed in claim 9, wherein the shaft is mounted on the lid, and removal of the lid from the drum removes the mixing mechanism from the drum.

11. A microwave vacuum drying apparatus as claimed in claim 10, wherein the shaft is mounted on the drum, and the drive motor is attached beneath the drum.

12. A microwave vacuum drying apparatus as claimed in claim 7, wherein the drum has a depth allowing a layer of product to be placed over the shaft and blades such that microwave penetration through the layer of product to the shaft and blades is minimal.

13. A microwave vacuum drying apparatus as claimed in claim 12, wherein the shaft or blades are constructed of a metallic material.

14. A microwave vacuum drying apparatus as claimed in claim 1, wherein the chamber is adapted to allow a spray of fluid onto the product during the drying operation.

15. A chamber for drying products with a combination of microwaves and a vacuum, comprising, in combination:

a vertically oriented drum;

a lid on the top of the drum;

a mixing mechanism within the drum;

an input port for a source of microwave radiation position above the drum; and a support for the chamber comprising a stand supporting the lid and a rolling cart supporting the drum with the drum pivotally mounted on the rolling cart, whereby the drum may be loaded or unloaded by rolling the cart away from the stand and pivoting the drum of the cart to dump the product, and with the drum being of sufficient depth to allow coverage, by the product of the mixing mechanism such that penetration of microwaves from the input port to the mixing mechanism is prevented.

16. A chamber as claimed in claim 15, wherein the chamber is surrounded by a water jacket that may be heated to prevent condensation of condensed solvent from the dried product on the interior surfaces of the chamber.

17. A chamber as claimed in claim 16, wherein a vacuum may be drawn in the chamber, and the microwave input port and the inlet to the chamber for drawing the vacuum are contained on the lid.

18. A chamber as claimed in claim 17, further comprising sensors that sense internal microwave field strength, internal temperature and internal pressure, with the sensors mounted on the lid.

19. A chamber as claimed in claim 18, wherein the mixing mechanism is motor driven, and the drive motor is mounted on the stand.

20. A chamber as claimed in claim 18, wherein the mixing mechanism is motor driven, with the drive motor mounted on the stand and detachably coupled to the drum.

21. A chamber as claimed in claim 15, wherein the mixing mechanism comprises a motor driven rotatable shaft internal to the chamber, with the shaft having one or more mixing blades that mix the product as the shaft rotates.

22. A microwave vacuum drying apparatus as claimed in claim 21, wherein the shaft is horizontal.

* * * * *